US009339107B1

(12) United States Patent
Madore

(10) Patent No.: US 9,339,107 B1
(45) Date of Patent: May 17, 2016

(54) PORTABLE BEDSIDE TABLE

(71) Applicant: Robert Madore, Terryville, CT (US)

(72) Inventor: Robert Madore, Terryville, CT (US)

( * ) Notice: Subject to any disclaimer, the term of this patent is extended or adjusted under 35 U.S.C. 154(b) by 0 days.

(21) Appl. No.: 14/885,143

(22) Filed: Oct. 16, 2015

(51) Int. Cl.
*A47B 23/02* (2006.01)
*A47B 83/04* (2006.01)
*A47B 79/00* (2006.01)

(52) U.S. Cl.
CPC ..... *A47B 23/025* (2013.01); *A47B 83/04* (2013.01); *A47B 79/00* (2013.01)

(58) Field of Classification Search
CPC ..... A47B 23/00; A47B 23/02; A47B 23/025; A47B 23/046; A47B 2023/048; A47B 83/04; A47B 79/00
USPC ..... 108/49
See application file for complete search history.

(56) References Cited

U.S. PATENT DOCUMENTS 4,313,589 A * 2/1982 Vega ..... A47B 23/04 248/444.1
5,009,379 A 4/1991 Sadler
5,038,434 A * 8/1991 Navarrette ..... A47B 23/025 108/49
5,359,741 A * 11/1994 Lang ..... A47B 23/046 108/140
5,642,541 A 7/1997 Corbin

* cited by examiner

*Primary Examiner* — Daniel Rohrhoff
(74) *Attorney, Agent, or Firm* — Crossley & Stevenson IP Law

(57) ABSTRACT

A portable bedside table including a base, a pair of vertical side supports disposed atop a top surface of the base, and a pair of U-shaped apertures including a right aperture and a left aperture. The right aperture and the left aperture is disposed within a back edge of a right side support and a left side support of the pair of side supports, respectively. An L-shaped first shelf is continuously disposed between an interior surface of each of the right side support and the left side support. A horizontally disposed rectangular second shelf has a rear surface attached to a front side of the base. The pair of apertures is configured to removably encircle a mattress and, alternately, the second shelf is configured to removably attach to an underside of the mattress, such that the pair of side supports is adjacent to the mattress.

4 Claims, 4 Drawing Sheets

PORTABLE BEDSIDE TABLE

BACKGROUND OF THE INVENTION

Various types of bedside tables are known in the prior art. However, what has been needed is a portable bedside table including a base, a pair of vertical side supports disposed atop a top surface of the base, and a pair of U-shaped apertures including a right aperture and a left aperture. What has been further needed is for the right aperture and the left aperture to be disposed within a back edge of a right side support and a left side support of the pair of side supports, respectively. Lastly, what has been needed is an L-shaped first shelf continuously disposed between an interior surface of each of the right side support and the left side support, and a horizontally disposed rectangular second shelf having a rear surface attached to a front side of the base. The pair of apertures is configured to removably encircle a mattress and, alternately, the second shelf is configured to removably attach to an underside of the mattress, such that the pair of side supports is adjacent to the mattress. The pair of apertures is specifically structured to optionally encircle the mattress in order to conserve space in a small area including, but not limited to, a dorm room, hotel room, and bedroom on a cruise ship. The portable bedside table thus provides a temporary and portable storage space when a typical bedside table fails to fit within the space constraints in a room.

FIELD OF THE INVENTION

The present invention relates to bedside tables, and more particularly, to a portable bedside table.

SUMMARY OF THE INVENTION

The general purpose of the present portable bedside table, described subsequently in greater detail, is to provide a bedside table which has many novel features that result in a portable bedside table which is not anticipated, rendered obvious, suggested, or even implied by prior art, either alone or in combination thereof.

To accomplish this, the present portable bedside table includes a base having a right side, a left side, a front side, a back side, and a top surface. The base is optionally rectangular. A pair of vertical side supports includes a right side support and a left side support. Each of the right side support and the left side support has a front edge, a back edge, a curved top edge, a bottom edge, and an interior surface. The bottom edge of each of the right side support and the left side support is disposed atop the top surface of the base along the right side of the base and the left side of the base, respectively. The front edge of each of the right side support and the left side support is collinearly disposed with the front side of the base. A width of each of the pair of vertical supports substantially conforms to a width of the base. A pair of U-shaped apertures includes a right aperture and a left aperture. Each of the right aperture and the left aperture is disposed within the back edge of each of the right side support and the left side support, respectively, at approximately one-third of a height of one of the pair of side supports from the bottom edge.

The portable bedside table further includes an L-shaped first shelf and a horizontally disposed rectangular second shelf. The first shelf has an elongated horizontally disposed lower support and a vertically disposed upper support. The lower support is continuously disposed between the interior surface of each of the right side support and the left side support proximal a top end of the pair of apertures, and the upper support is continuously disposed between the interior surface of each of the right side support and the left side support from proximal the top end of the pair of apertures to the top edge of each of the pair of side supports. A back surface of the upper support is collinearly disposed with the back edge of each of the pair of side supports. The second shelf has a rear surface attached to the front side of the base from the left side of the base and, alternately, from the right side of the base, to approximately a midpoint of a length of the base. A diameter of each of the pair of apertures substantially conforms to a height of a mattress. The pair of apertures is configured to removably encircle the mattress and, alternately, the second shelf is configured to removably attach to an underside of the mattress, such that the pair of side supports is adjacent to the mattress.

The portable bedside table optionally includes a substantially convexly curved arm having a right surface attached to the interior surface of the right side support proximal the front edge, and a left surface attached to the interior surface of the left side support proximal the front edge. The right surface of the arm is collinearly disposed with the left surface of the arm.

Thus has been broadly outlined the more important features of the present portable bedside table so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
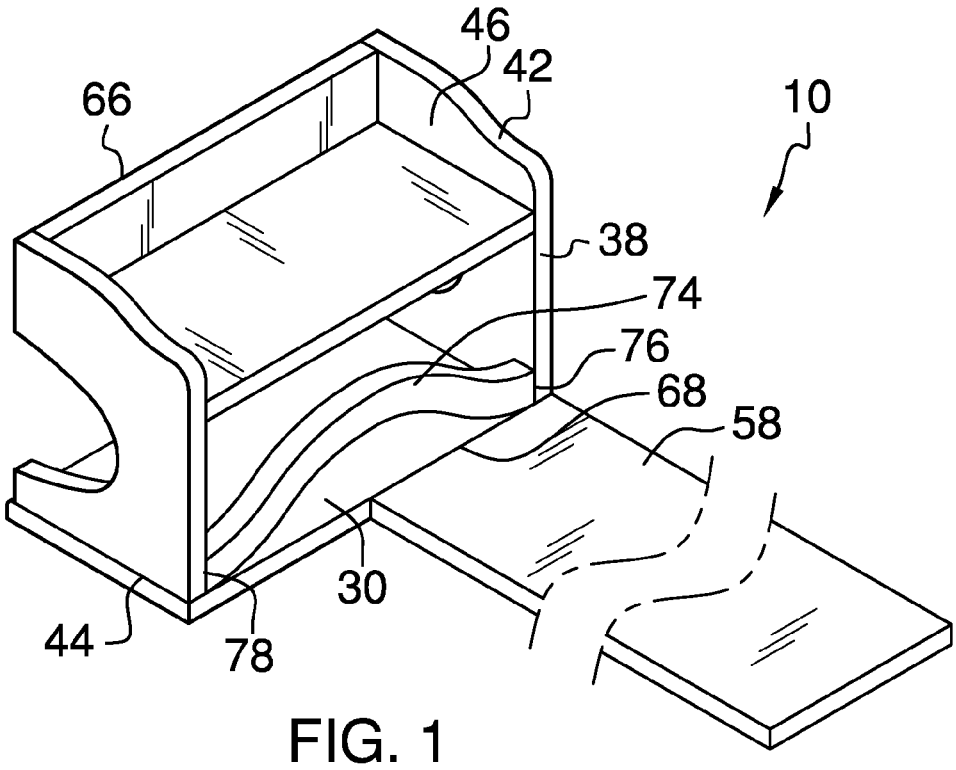
FIG. 1 is a front isometric view.
Figure 2:
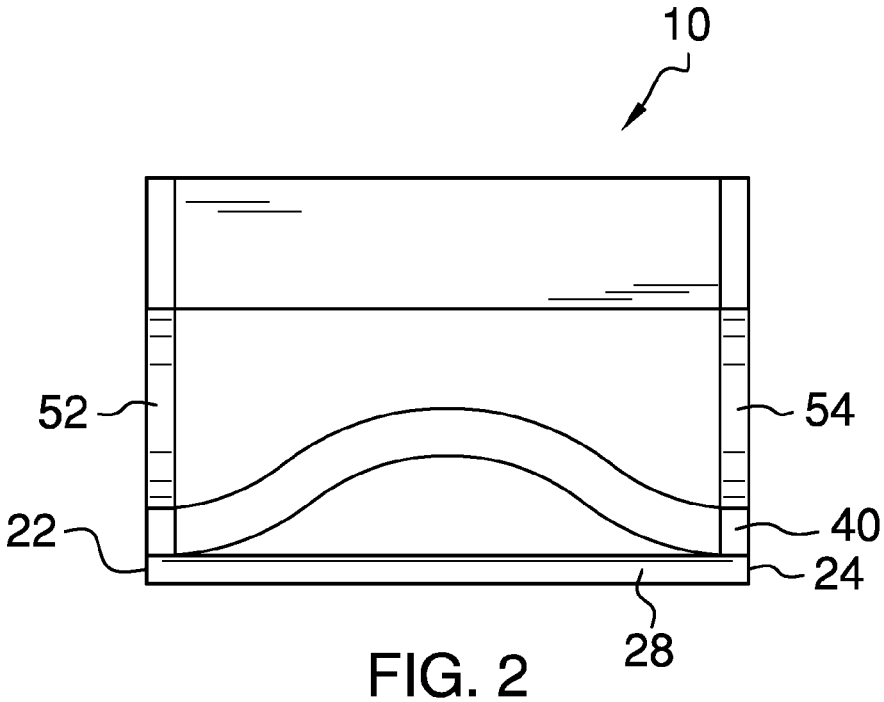
FIG. 2 is a rear elevation view.
Figure 3:
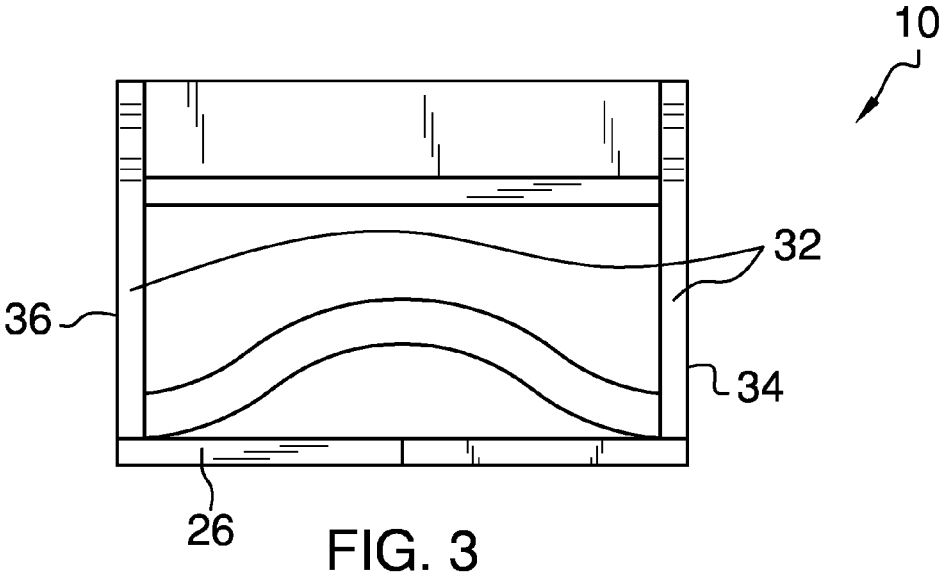
FIG. 3 is a front elevation view.
Figure 4:
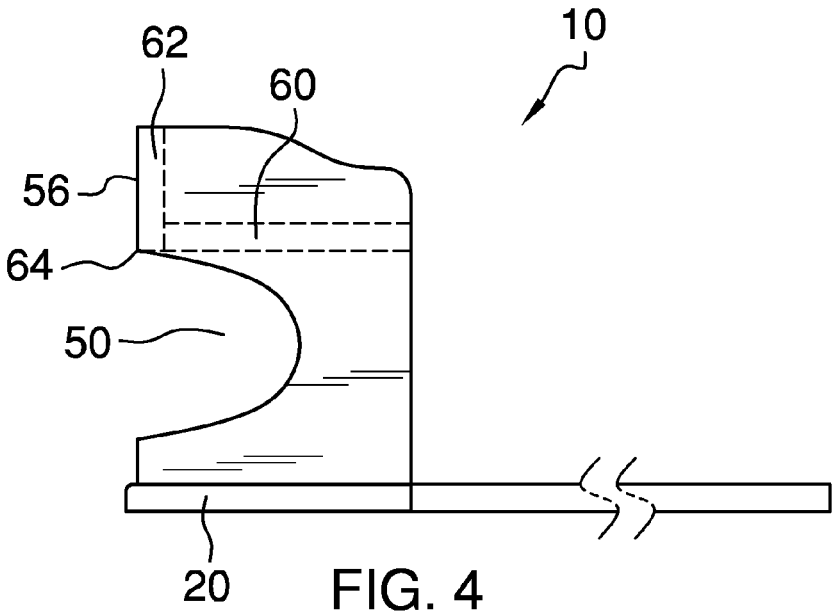
FIG. 4 is a side elevation view.

With reference now to the drawings, and in particular FIGS. 1 through 6 thereof, an example of the instant portable bedside table employing the principles and concepts of the present portable bedside table and generally designated by the reference number 10 will be described.

Referring to FIGS. 1 through 6 the present portable bedside table 10 is illustrated. The portable bedside table 10 includes a base 20 having a right side 22, a left side 24, a front side 26, a back side 28, and a top surface 30. The base 20 is optionally rectangular. A pair of vertical side supports 32 includes a right side support 34 and a left side support 36. Each of the right side support 34 and the left side support 36 has a front edge 38, a back edge 40, a curved top edge 42, a bottom edge 44, and an interior surface 46. The bottom edge 44 of each of the right side support 34 and the left side support 36 is disposed atop the top surface 30 of the base 20 along the right side 22 of the base 20 and the left side 24 of the base 20, respectively. The front edge 38 of each of the right side support 34 and the left side support 36 is collinearly disposed with the front side 26 of the base 20. A width of each of the pair of vertical supports 32 substantially conforms to a width of the base 20. A pair of U-shaped apertures 50 includes a right aperture 52 and a left aperture 54. Each of the right aperture 52 and the left aperture 54 is disposed within the back edge 40 of each of the right side support 34 and the left side support 36, respectively, at approximately one-third of a height of one of the pair of side supports 32 from the bottom edge 44.

Figure 5:
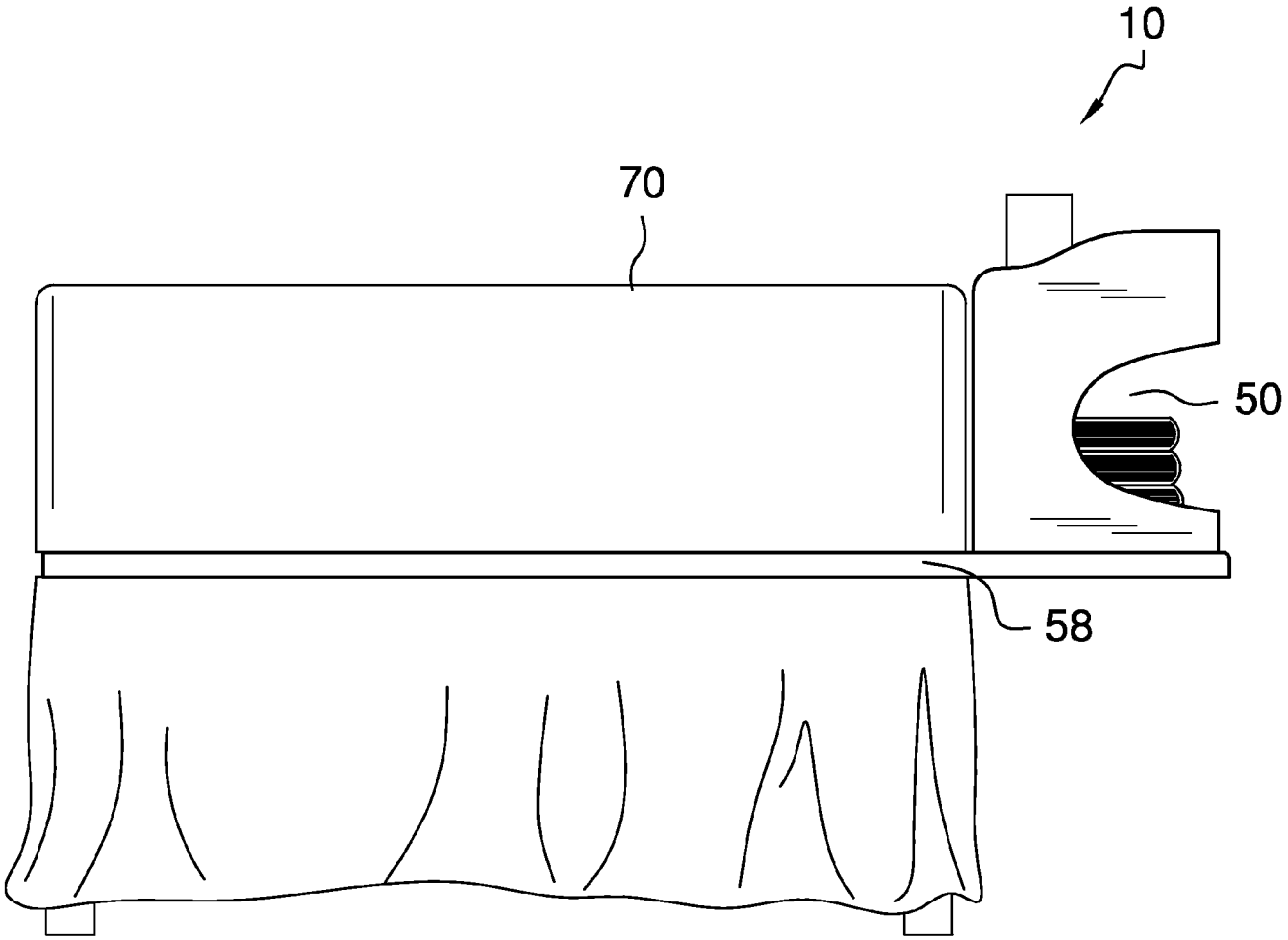
FIG. 5 is an in use view showing a second shelf attached to an underside of a mattress.
Figure 6:
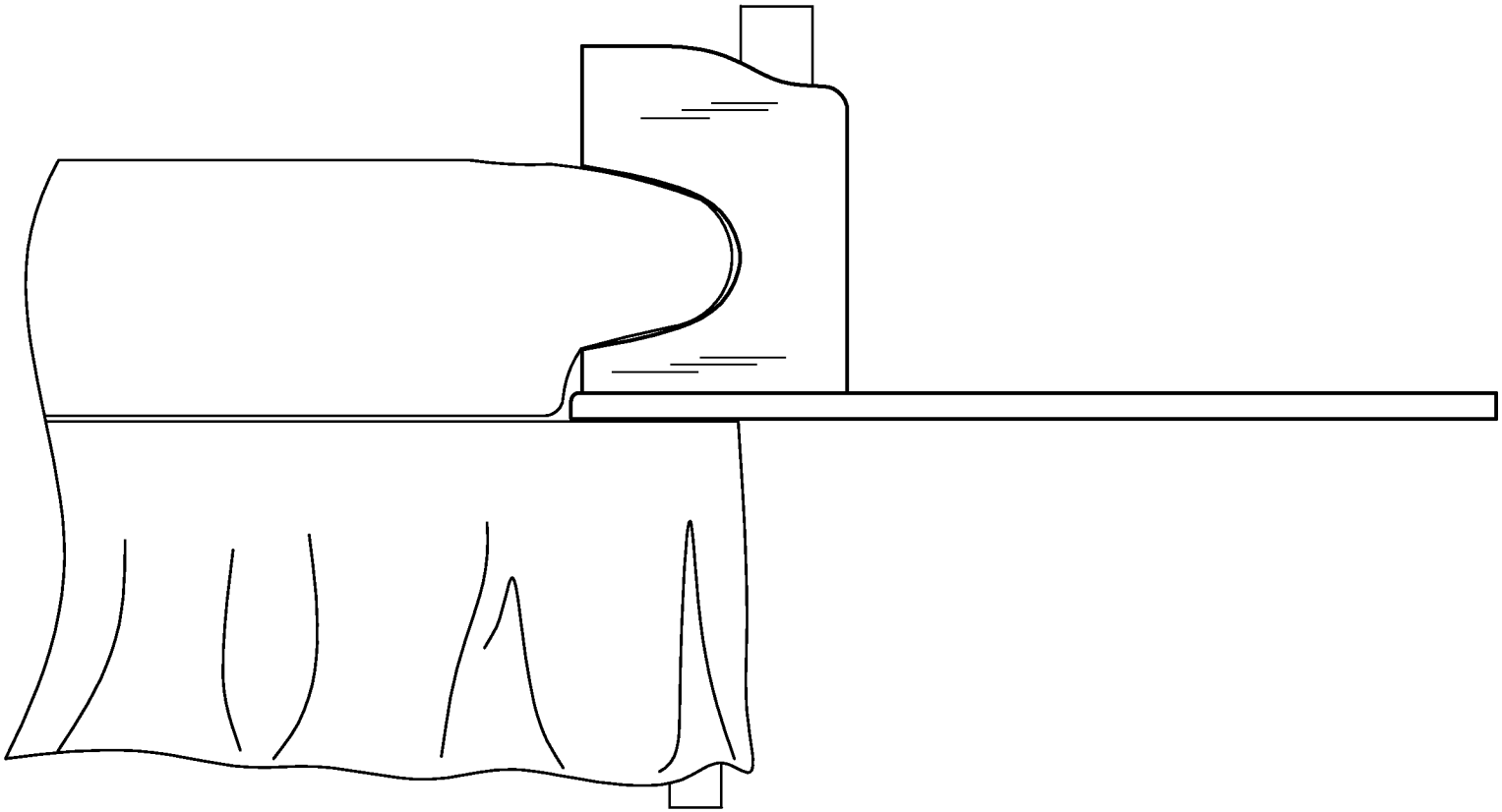
FIG. 6 is an in-use view showing a pair of apertures encircling the mattress.

The portable bedside table 10 further includes an L-shaped first shelf 56 and a horizontally disposed rectangular second shelf 58. The first shelf 56 has an elongated horizontally disposed lower support 60 and a vertically disposed upper support 62. The lower support 60 is continuously disposed between the interior surface 46 of each of the right side support 34 and the left side support 36 proximal a top end 64 of the pair of apertures 50, and the upper support 62 is continuously disposed between the interior surface 46 of each of the right side support 34 and the left side support 36 from proximal the top end 64 of the pair of apertures 50 to the top edge 42 of each of the pair of side supports 32. A back surface 66 of the upper support 62 is collinearly disposed with the back edge 40 of each of the pair of side supports 32. The second shelf 58 has a rear surface 68 attached to the front side 26 of the base 20 from the left side 24 of the base 20 and, alternately, from the right side 22 of the base 20, to approximately a midpoint of a length of the base 20. As best shown in FIGS. 5 and 6, the pair of apertures 50 is configured to removably encircle a mattress 70 and, alternately, the second shelf 58 is configured to removably attach to an underside 72 of the mattress 70, such that the pair of side supports 32 is adjacent to the mattress 70.

The portable bedside table 10 optionally includes a substantially convexly curved arm 74 having a right surface 76 attached to the interior surface 46 of the right side support 34 proximal the front edge 38, and a left surface 78 attached to the interior surface 46 of the left side support 36 proximal the front edge 38. The right surface 76 of the arm 74 is collinearly disposed with the left surface 78 of the arm 74.

What is claimed is:

1. A portable bedside table comprising:

a base having a right side, a left side, a front side, a back side, and a top surface;

a pair of vertical side supports comprising a right side support and a left side support, each of the right side support and the left side support having a front edge, a back edge, a curved top edge, a bottom edge, and an interior surface, wherein the bottom edge of each of the right side support and the left side support is disposed atop the base top surface along the base right side and the base left side, respectively, wherein the front edge of each of the right side support and the left side support is collinearly disposed with the base front side;

wherein a width of each of the pair of vertical supports substantially conforms to a width of the base;

a pair of U-shaped apertures comprising a right aperture and a left aperture, wherein each of the right aperture and the left aperture is disposed within the back edge of each of the right side support and the left side support, respectively, at approximately one-third of a height of one of the pair of the side supports from the bottom edge;

an L-shaped first shelf having an elongated horizontally disposed lower support and a vertically disposed upper support, wherein the lower support is continuously disposed between the interior surface of each of the right side support and the left side support proximal a top end of the pair of apertures, and the upper support is continuously disposed between the interior surface of each of the right side support and the left side support from proximal the top end of the pair of apertures to the top edge of each of the pair of side supports, wherein a back surface of the upper support is collinearly disposed with the back edge of each of the pair of side supports; and a horizontally disposed rectangular second shelf having a rear surface attached to the base front side from the base left side and, alternately, from the base right side to approximately a midpoint of a length of the base;

wherein a diameter of each of the pair of apertures substantially conforms to a height of a mattress;

wherein the pair of apertures is configured to removably encircle the mattress and, alternately, the second shelf is configured to removably attach to an underside of the mattress, such that the pair of side supports is adjacent to the mattress.

2. The portable bedside table of claim 1 further comprising a substantially convexly curved arm having a right surface attached to the interior surface of the right side support proximal the front edge, and a left surface attached to the interior surface of the left side support proximal the front edge, wherein the arm right surface is collinearly disposed with the arm left surface.

3. The portable bedside table of claim 2 wherein the base is rectangular.

4. The portable bedside table of claim 1 wherein the base is rectangular.

* * * * *